US005282679A

United States Patent [19]

Redelinghuys

[11] Patent Number: 5,282,679

[45] Date of Patent: Feb. 1, 1994

[54] ARTICLE OF FURNITURE

[76] Inventor: Marthinus J. W. Redelinghuys, P O Box 36, Schagen, 1207, South Africa

[21] Appl. No.: 886,793

[22] Filed: May 21, 1992

[30] Foreign Application Priority Data

May 22, 1991 [ZA] South Africa ..... 91/3869

[51] Int. Cl.[5] ..... A47B 88/00

[52] U.S. Cl. ..... 312/316; 108/48

[58] Field of Search ..... 312/204, 315, 316; 108/48, 134

[56] References Cited

U.S. PATENT DOCUMENTS 361,667 4/1887 Bearden ..... 312/316

2,784,004 3/1957 Hamrick ..... 108/48

*Primary Examiner*—Kenneth J. Dorner

*Assistant Examiner*—Gerald A. Anderson

*Attorney, Agent, or Firm*—Ladas & Parry

[57] ABSTRACT

The invention provides an article of furniture including a closable cabinet (10) of six-sided rectangular configuration, having top and bottom walls, rear and front walls, and a pair of upright side walls. The front wall constitutes a displaceable panel hingedly mounted on the bottom wall to permit pivotal displacement of the panel from an upright closed position in which it closes the cabinet to an open position in which it is disposed in a substantially horizontal position coplanar with a support surface provided by the bottom wall. At least one foldable support leg is provided on the displaceable panel, a leg being comprised of at least two sections hingedly connected together at a hinge point intermediate of its two extreme ends. The one extreme end is pivotally secured to the displaceable panel and the other extreme end is pivotally secured to a stationary part of the article. In the open position the panel is supported on the foldable legs.

6 Claims, 3 Drawing Sheets

ARTICLE OF FURNITURE

This invention relates to an article of furniture. More particularly the invention relates to a versatile and utilitarian article of furniture intended to be used as a storage cabinet, desk, computer work station, book case, liquor cabinet, cabinet for a sewing machine, food processor or similar appliance, and for many other useful purposes.

According to the invention there is provided an article of furniture which includes an operatively horizontally disposed support surface;

at least one displaceable panel hingedly mounted to be displaceable from an upright closed position to an open position in which it is disposed in a substantially horizontal position level with the support surface;

at least one foldable leg provided on the displaceable panel, the foldable support leg being comprised of at least two sections hingedly connected together at a hinge point intermediate of its two extreme ends;

the one extreme end of the support leg being pivotally secured to the displaceable panel and the other extreme end being pivotally secured to a stationary part of the article; the arrangement being such that the displaceable panel can be brought to an upright closed position in which is obscures the support surface and in which the support leg is in a straightened condition, and to an open position in which it gives access to the support surface and is disposed substantially horizontal to provide a work surface level with the support surface, and in which position the support leg is folded into an angular configuration to be supported on the hinge point and with one section thereof extending between the article and the hinge point and another section disposed substantially upright to support the said displaceable panel in the open position.

When the foldable support leg is in the straightened condition it may conveniently be arranged snugly adjacent an outer face of the article, to present a neat appearance.

The article may include a closable cabinet having opposed top and bottom walls and upright side walls to define an enclosed space. The bottom wall of the closable cabinet may preferably constitute the horizontally disposed support surface, and an upright wall of the cabinet, preferably the front wall of the cabinet, may constitute the displaceable panel. The front wall may thus be displaceable from an upright closed position in which it closes the cabinet, to an open position in which it is disposed in a substantially horizontal position coplanar with the support surface provided by the bottom wall.

The displaceable wall may thus be mounted on the unit in such a manner that when it is in the open position, it will be disposed substantially coplanar with the support surface in the cabinet, so as to provide an extended or enlarged working surface. As indicated above, the support surface in the cabinet may be provided by the bottom wall of the cabinet. In use, the area of the extended or enlarged working surface will comprise the total of the area of the support surface and the area of the displaceable wall.

The cabinet may have a six-sided rectangular configuration, in use having rectangular spaced and parallel top and bottom walls, rectangular spaced and parallel upright rear and front walls, and a pair of rectangular spaced and parallel upright side walls. As indicated above, the upright front wall may conveniently be the displaceable wall.

The front wall constituting the displaceable panel may be hingedly mounted on the bottom wall along its lower edge, to permit pivotal displacement of the front wall around an axis extending substantially parallel to its lower edge, its three other sides not being secured to the side and top walls, the arrangement being such that it can be displaced pivotally from an upright closed position, in which its three unsecured edges are located adjacent the side and top walls so that it closes the cabinet, to an open position in which it is disposed substantially horizontal and coplanar with the bottom wall to constitute with the bottom wall an extended or enlarged work surface.

Support means may be provided to support the cabinet at such a height that the bottom wall thereof will be located on desktop level. The support means may comprise four stationary legs, one at each of the four corners of the rectangular bottom wall of the cabinet. The stationary legs may be of such a height that the bottom wall of the cabinet will be located on desktop level.

Alternatively, the support means may comprise side panels forming part of a secondary storage compartment located below the cabinet and having at least one closable door arranged to open and close below the displaceable panel when the latter is in the open position. The secondary compartment may be utilised for storing equipment or accessories, and may optionally be provided with one or more shelves.

Two laterally spaced foldable support legs may conveniently be provided to support the displaceable panel when it is in the open position, the legs being positioned to support the said panel at unsupported edge regions thereof, e.g. at or near each of the two unsecured corners of the said panel. As indicated above, a foldable support leg may be comprised of two elongated sections hingedly secured together in co-axially aligned relative positions. One free end of either support leg may be connected hingedly to the displaceable panel at or near an unsecured corner thereof. The other free end of a support leg may be connected pivotally, such as by means of a transverse pin, to a stationary part of the cabinet, e.g. to the stationary legs of the cabinet where such legs are provided, or to the side panels forming part of a secondary compartment. The said pivotal connection of the foldable legs may preferably be to points at or near the lowermost or basal part of the article, i.e. to be located at or near the floor when the article is used.

In use, when the displaceable wall is brought to its open position, i.e. a position in which it is disposed substantially horizontal and coplanar with the bottom wall of the cabinet, its forward unsupported corners will be supported by the foldable support legs, which support legs will have been extended into supports of angular configuration supported on their hinge points. One section of either support leg, i.e. the section hingedly secured to an unsupported corner of the displaceable wall, will be positioned substantially upright to serve as a leg, while the other section of a support leg, i.e. the section pivotally secured to the basal or lowermost part of the article, will extend between the article and the hinge point. In practice this will usually be along the ground, thus providing a stable and sturdy support structure.

When the displaceable wall is brought to the closed position in which it is disposed upright to form the front wall of the cabinet so as to close the cabinet, both foldable support legs are drawn up and straightened until they are positioned adjacent the front face of the cabinet.

The article according to the invention may be made of wood, to serve as a useful piece of furniture. For example, the unit may be used as a fold-away desk, in which case the cabinet may have one or more shelves or drawers for books and other items. The unit may also be used as a fold-open book case for containing books, so that the folded-out front wall may provide a working area where a book may be read or otherwise used.

In a preferred embodiment, the unit may be used as a cabinet for a sewing machine, a food processor or the like. Thus, the cabinet may be used to house a sewing machine, and if desired also an overlocking machine. In this case, a special displaceable platform may be provided on which the appliance, e.g. the sewing machine, may be placed. The platform may be placed on the bottom wall of the cabinet, and it may be displaceable from an inoperative retracted position on the bottom wall within the cabinet, to an operative extended position on the extended work surface provided by the displaceable panel in its open position. For example, the platform may be rotatably secured to the bottom wall by a single rotational pin or peg, so as to be capable of being pivoted or swivelled around the pin or peg from an inoperative position on the bottom wall within the cabinet, to an operative position on the extended work surface.

Alternatively, the platform may be slidably displaceable, and a slide track may be provided to control the displacement of the platform, the track having stop means to permit limited linear sliding displacement of the displaceable platform along the track from the inoperative retracted position to the operative extended position. In this manner the appliance may be brought into a more accessible position, where it is within easy reach for an operator to work on.

When the appliance is not being used, it may be moved away on its platform to the inoperative position, the cabinet may be closed, and the work area will look tidy.

The unit may also be used as a work station for a personal computer, word processor, typewriter or the like. If desired, the computer, word processor or typewriter may again be placed on a displaceable platform as described herein, to be displaced from an inoperative position at the back of the cabinet, to an operative position in front on the extended wall. Where the appliance is a computer or a word processor having a separate keyboard, the keyboard may be mounted on the displaceable wall, conveniently on the upper surface thereof. When the wall is then moved to the closed position, the keyboard will be put away inside the cabinet, where it may for example hang suspended against the inside of the said wall.

The unit according to the invention may be of any suitable dimensions, as required in use. If desired, it may be of such lateral dimensions that more than one appliance may be positioned therein, one adjacent the other.

The invention and the manner in which it may be put into practice will now be described by way of example, with reference to the accompanying diagrammatic drawings.

In the drawings

Figure 1:
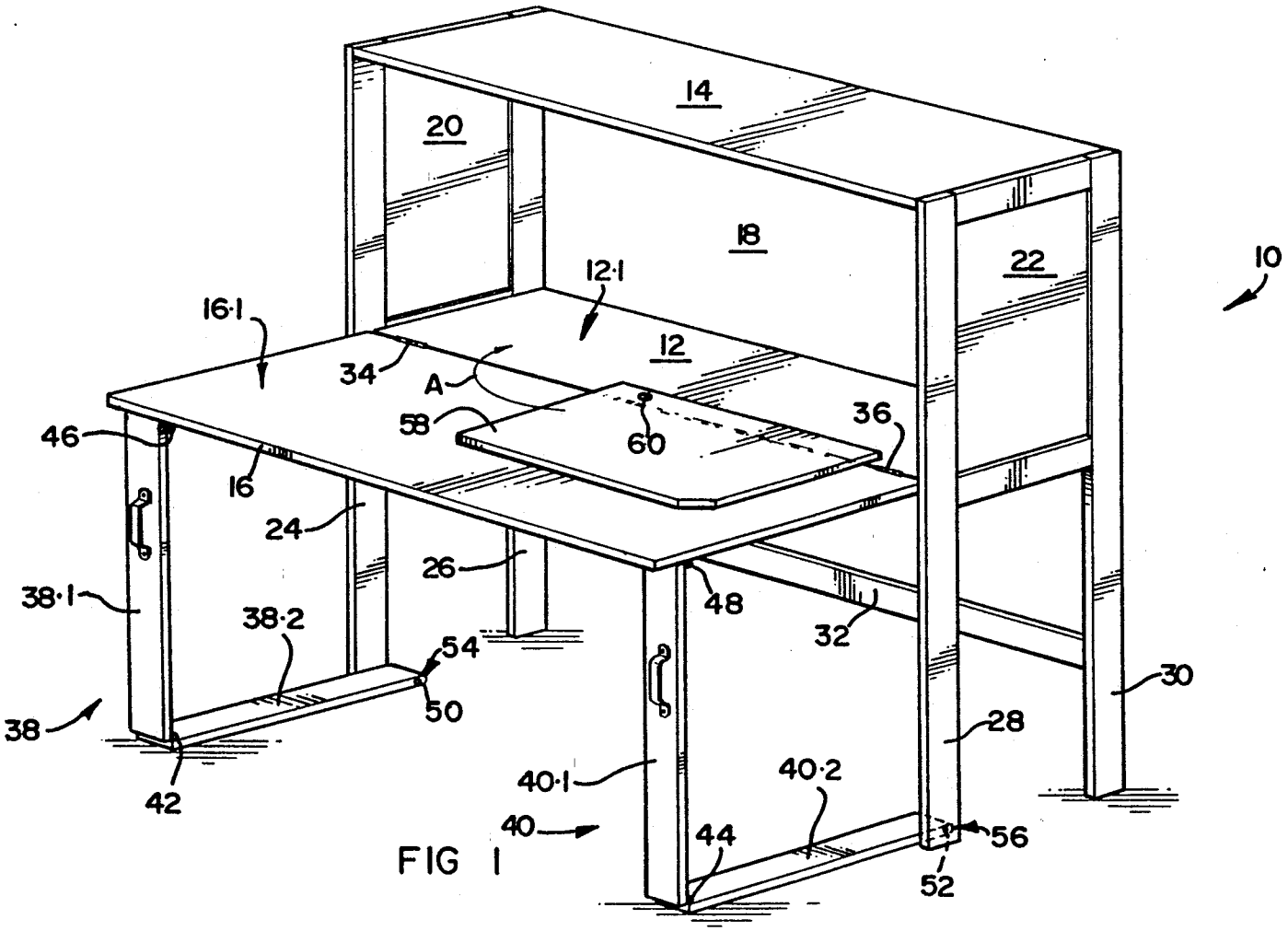
FIG. 1 is a diagrammatic three-dimensional view of an article of furniture in accordance with the invention, in the form of a cabinet for an appliance such as a sewing machine, shown in the open position and with a part cut away.
Figure 2:
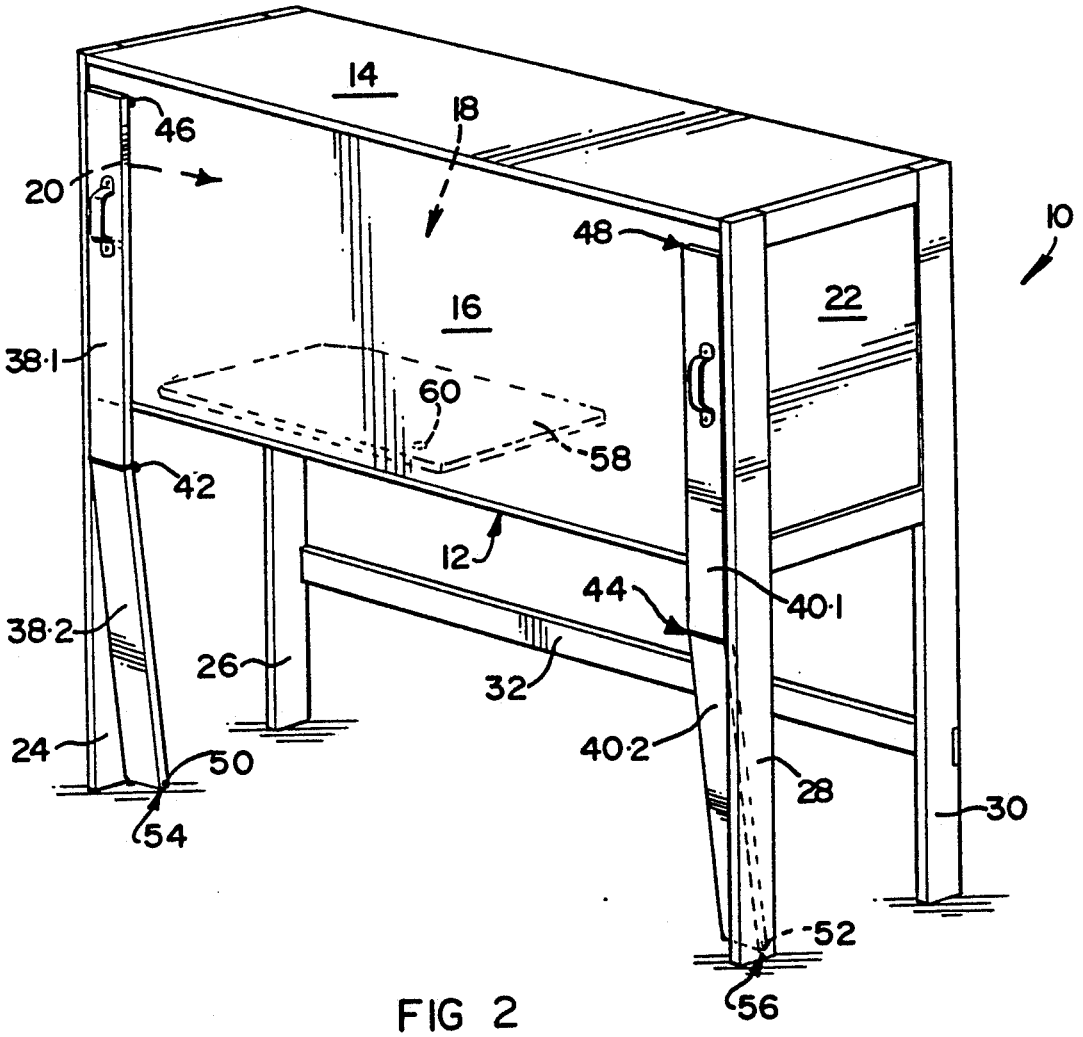
FIG. 2 is a diagrammatic three-dimensional view of the cabinet of FIG. 1, but shown in the closed position.

Referring to the drawings, there is provided in accordance with the invention an article of furniture in the form of a cabinet for an appliance such as a sewing machine, computer work station, etc. which comprises a closed rectangular cabinet generally shown as 10, having a bottom wall 12, a top wall 14, a front wall 16, a rear wall 18, and side walls 20, 22. The cabinet 10 shown in FIGS. 1 and 2 is supported on four stationary legs 24, 26, 28, 30 provided at the four corners of the bottom wall 12, the legs being of such a height and configuration that the bottom wall 12 of the cabinet is located on desktop level. A transverse strut 32 is provided between the two rear legs 26, 30.

Figure 3:
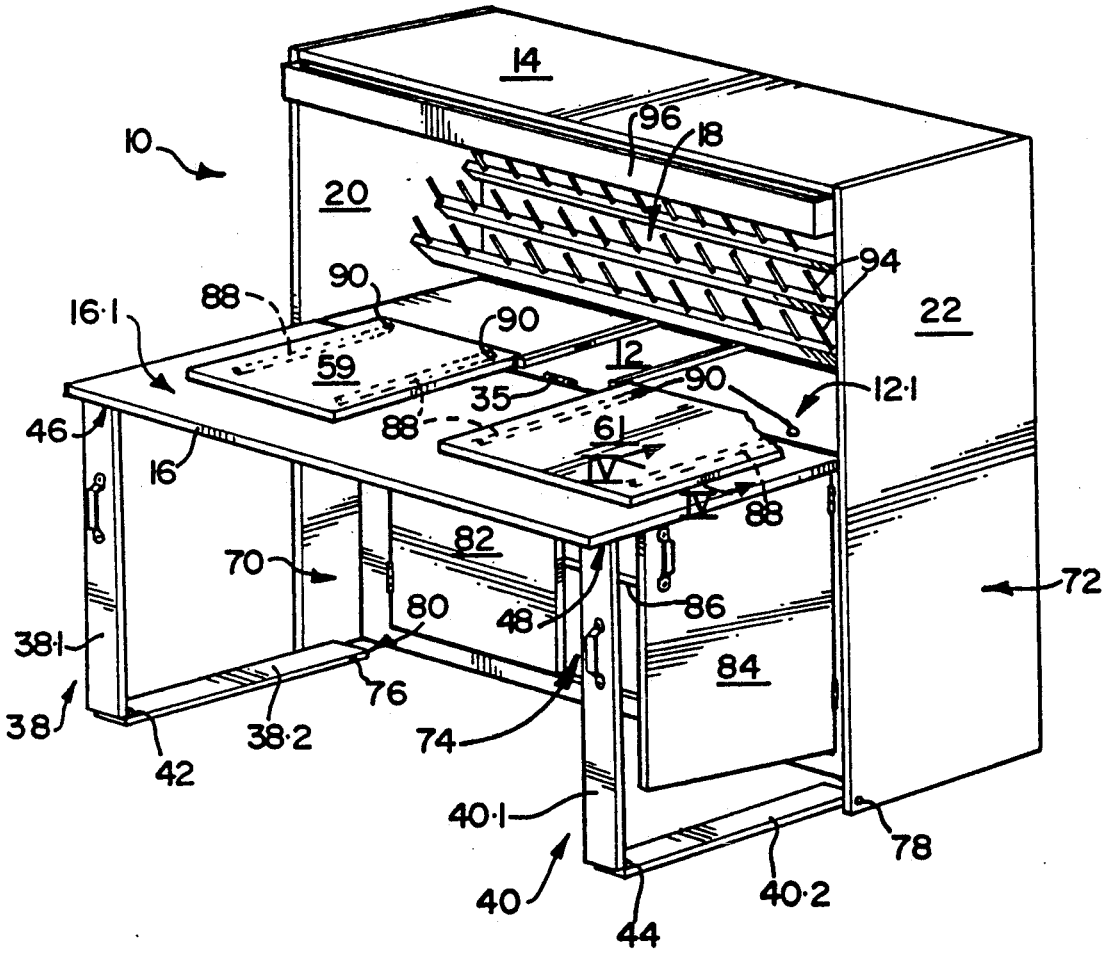
FIG. 3 is a diagrammatic three-dimensional view of a different embodiment of a cabinet intended for a sewing machine, and shown in the open position.

In the embodiment shown in FIG. 3, the cabinet 10 is supported on the side panels 70, 72 the upper parts of which form the side walls 20, 22 of the cabinet 10. The lower parts of the side panels 70, 72 form part of a secondary compartment generally indicated as 74, as explained more fully further below.

The front wall 16 of the cabinet is mounted on the bottom wall 12 by means of hinges 34, 35 and 36 as shown in FIGS. 1 and 3, to enable it to be displaced from an upright closed position, as shown in FIG. 2, in which it closes the cabinet 10 and obscures its contents from view, and an open position as depicted in FIGS. 1 and 3, in which it is disposed substantially horizontally and level with the bottom wall 12 of the cabinet 10.

It will be evident that the bottom wall 12 of the cabinet constitutes a support surface 12.1 on which appliances or other items may be supported. When the displaceable wall 16 is brought to its open position, it provides a work surface 16.1 level with the support surface, and together the two surfaces constitute an enlarged working area.

Two foldable support legs generally shown as 38 and 40 are provided to support the displaceable wall 16 in its open position. Each support leg comprises two elongated sections 38.1, 38.2 and 40.1, 40.2 respectively, the two sections of a leg being secured together by means of hinges 42, 44. One free end of each support leg 38, 40 is secured near the free corners of the displaceable wall 16 by means of hinges as shown at 46, 48. The other free end of each support leg 38, 40 is pivotally connected to a stationary part of the article, preferably at a point close to the ground. Thus, in the embodiment shown in FIGS. 1 and 2, the foldable legs 38, 40 are secured to the front stationary legs 24, 28 of the cabinet 10, by means of transverse pins 50, 52. As shown in the drawings, these ends of the foldable legs 38, 40 so connected are rounded, as shown at 54, 56, to enable the foldable legs 38, 40 to pivot relative to the stationary legs 24, 28.

In the embodiment shown in FIG. 3, the foldable legs 38, 40 are pivotally connected to the side panels 70, 72 by means of pins 76, 78. The end configuration of the legs is again rounded, as shown at 80, to permit pivotal movement.

In use, when the displaceable wall 16 is brought to its open position, as depicted in FIGS. 1 and 3, the foldable legs 38, 40 are extended into supports of angular configuration, with sections 38.2 and 40.2 extending along the floor between the stationary supports 24, 28 and 70, 72 and the hinge points 42, 44, and sections 38.1 and 40.1 being positioned substantially upright to support the wall 16 in the open position. The hinge points 42, 44 rest on the ground.

When the displaceable wall 16 is brought to the closed position, as depicted in FIG. 2, in which it is disposed upright to form the front wall of and to close the cabinet 10, both foldable support legs 38, 40 are drawn up and straightened until they are positioned adjacent the front face of the cabinet 10. If necessary, suitable clip-in securing devices (not shown) may be provided in suitable positions on the foldable legs 38, 40 and the displaceable wall 16, to secure the legs 38, 40 against the wall 16 when the latter is in the closed position.

In the embodiment shown in FIG. 3, a secondary closable storage compartment 74 is provided below the cabinet 10. This compartment will serve to support the cabinet 10, and will provide additional storage space. The compartment 74 is provided with closable doors 82, 84 which open below the displaceable panel 16, and may have one or more shelves 86, as may be required in practice.

The unit according to the invention may be made of wood, to serve as a versatile and useful piece of furniture. For example, the unit may be used as a fold-away desk, in which case the cabinet 10 may have one or more shelves or drawers for books and other items. The unit may also be used as a fold-open book case for containing books, so that the folded-out front wall may provide a working area where a book may be read or otherwise used.

In a preferred embodiment, as illustrated in FIGS. 1, 2 and 3, the unit may be used as a cabinet for a sewing machine, food processor or the like. Thus, the cabinet 10 may be used to house a sewing machine (not shown). In this case, one or more special displaceable platforms 58, 59, 61 are provided on which the appliance, e.g. the sewing machine and/or overlocking machine (not shown), may be placed. The platforms 58, 59, 61 are placed on the bottom wall 12 of the cabinet, and are displaceable from an inoperative retracted position on the bottom wall 12 of the cabinet 10 (as shown in broken lines in FIG. 2), to an operative extended position on the extended work surface 16.1 of the displaceable wall 16 (as shown in FIGS. 1 and 3).

Figure 4:
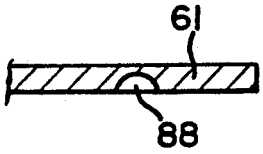
FIG. 4 is a partial sectional view, on an enlarged scale, of the displaceable platform 61, taken along line IV—IV in FIG. 3.

For example, the displaceable platform 58 shown in FIGS. 1 and 2 may be rotatably secured by a single upright pin or peg 60, so as to be capable of being pivoted or swivelled around the pin or peg 60 from an inoperative retracted position on the bottom wall within the cabinet (as shown in broken lines in FIG. 2), to an operative extended position on the extended front wall 16, as shown in FIG. 1. Alternatively, the displaceable platforms 59, 61 shown in FIG. 3 may be linearly slidable by way of slide tracks in the form of grooves 88 formed in the underside of the platform 59, 61 and shown in broken lines in FIG. 1 and depicted in FIG. 4, and stop buttons, 90, to permit linear sliding displacement of the platforms from the retracted inoperative position within the cabinet 10, to the extended operative position as depicted in FIG. 3.

In this manner the appliance placed on a platform may be brought into a more accessible position, where it is within easy reach for an operator to work on.

When the appliance is not being used, it may be displaced on its platform to the retracted inoperative position, the cabinet 10 may be closed, and the work area will look tidy.

It should be understood that further utility features may be added to the article, to improve its versatility and utility. Thus, as illustrated in FIG. 3, pegs 94 may be mounted against the rear wall 18 of the cabinet 10 to hold reels of cotton (not shown) where the cabinet is to be used for housing a sewing machine. An additional drawer 96 may also be provided.

The unit may also be used as a work station for a personal computer, word processor, typewriter or the like. If desired, the computer, word processor or typewriter may again be placed on the platform 58, 59 or 61 to be displaced from an inoperative retracted position at the back of the cabinet, to an operative extended position in front on the extended wall 16. Where the appliance is a computer or a word processor having a separate keyboard, the keyboard may be mounted on a specially provided shelf (not shown), or it may be mounted on the surface 16.1 of the displaceable wall 16. When the wall 16 is then moved to the closed position, the appliances will be put away inside the cabinet 10, where they will be stored in a safe and tidy manner.

I claim:

1. An article of furniture which includes a closable cabinet of six-sided generally rectangular configuration having a pair of opposed and vertically spaced walls to constitute a bottom wall and a top wall, a pair of spaced and upright walls to constitute a front wall and a rear wall, and a pair of spaced and upright side walls, the walls defining between them an enclosed space of generally rectangular configuration;

the bottom wall constituting an operatively horizontally disposed support surface, and the front wall being hingedly mounted along its lower edge on the bottom wall to constitute a displaceable panel pivotally displaceable around an axis extending substantially parallel to the said lower edge of the front wall, from an upright closed position in which the panel closes the cabinet to an open position in which the panel is disposed in a substantially horizontal position level with the support surface to provide together with the support surface an extended work surface;

stationary support means to support the cabinet at a height such that the bottom wall thereof is located at desktop level;

a pair of laterally spaced foldable support legs to support the displaceable panel when the said panel is in the open position, each leg being comprised of at least two sections hingedly connected together to provide a hinge point for each leg in a medial position relative to opposed extreme ends of the legs;

one extreme end of each support leg being hingedly attached to a lateral edge region of the displaceable panel, and the other extreme end of each support leg being pivotally connected to the stationary support means at a point located proximate to a basal part of the article of furniture;

the attachment of the foldable support legs to the displaceable panel being so arranged that when the displaceable panel in use is brought to the upright closed position the two support legs are brought to an unfolded and substantially straight configuration with the two sections of each leg in general alignment with one another, and when the displaceable panel is brought to the substantially horizontal open position the two support legs are folded into an angular configuration to be supported on the hinge point with one section of each leg extending substantially horizontally between the article and the hinge point and the other section disposed substantially upright to support the displaceable panel; and at least one displaceable platform being provided on the bottom wall of the cabinet, to be displaceable from an inoperative retracted position on the bottom wall within the cabinet, to an operative extended position on the extended work surface provided by the displaceable panel in its open position.

2. An article of furniture as claimed in claim 1, in which each displaceable platform is provided with at least one slide track in the form of a groove formed in its underside, and in which a cooperating stop means in the form of at least one button is provided on the bottom wall of the cabinet, to permit limited linear sliding displacement of the platform from the inoperative retracted position to the operative extended position.

3. An article of furniture as claimed in claim 1, in which the closable cabinet is intended to accommodate a sewing machine.

4. An article of furniture as claimed in claim 1, in which the closable cabinet is intended to accommodate a computer workstation.

5. An article of furniture as claimed in claim 1, in which the stationary support means includes a secondary storage compartment located below the cabinet and having at least one closable door.

6. An article of furniture as claimed in claim 1, in which each displaceable platform is rotatably secured on the bottom wall of the cabinet by a single upright pin, so that the displaceable platform is capable of pivotal movement around the pin from the inoperative retracted position to the operative extended position.

* * * * *